US006700105B2

(12) United States Patent
Morrison

(10) Patent No.: US 6,700,105 B2
(45) **Date of Patent: *Mar. 2, 2004**

(54) INDUCTION HEATING SYSTEM AND METHOD FOR INTERNAL COMBUSTION ENGINE

(75) Inventor: William Adam Morrison, Boaz, AL (US)

(73) Assignee: Tocco, Inc., Boaz, AL (US)

( * ) Notice: Subject to any disclaimer, the term of this patent is extended or adjusted under 35 U.S.C. 154(b) by 27 days.

This patent is subject to a terminal disclaimer.

(21) Appl. No.: 10/102,384

(22) Filed: Mar. 19, 2002

(65) Prior Publication Data

US 2003/0029863 A1 Feb. 13, 2003

Related U.S. Application Data

(63) Continuation-in-part of application No. 09/925,408, filed on Aug. 10, 2001.

(51) Int. Cl.[7] ..... H05B 6/06; H05B 6/10; F02M 27/04

(52) U.S. Cl. ..... 219/661; 219/663; 219/635; 322/32; 363/21; 363/97; 123/549

(58) Field of Search ..... 219/661, 663, 219/635, 601, 660, 628, 677; 322/32, 333, 34, 29; 363/21, 97, 98, 131; 123/549, 543, 220

(56) References Cited

U.S. PATENT DOCUMENTS 3,581,489 A * 6/1971 Camin et al. ..... 60/30
4,862,858 A * 9/1989 Goldsberry ..... 123/538
5,622,643 A * 4/1997 Morizot ..... 219/665
5,841,646 A * 11/1998 Cornec ..... 363/98
6,018,154 A * 1/2000 Izaki et al. ..... 219/661
6,237,576 B1 5/2001 Buccino et al.

FOREIGN PATENT DOCUMENTS

JP 57-151021 * 9/1982 ..... 123/568.29
JP 10272153 4/2000
JP 2000-100586 * 4/2000
WO WO 98/25014 6/1998
WO WO 99/67873 * 12/1999

OTHER PUBLICATIONS

U.S. patent application Ser. No. 09/925,408, filed Aug. 10, 2001.

* cited by examiner

*Primary Examiner*—Philip H. Leung
(74) *Attorney, Agent, or Firm*—Fay, Sharpe, Fagan, Minnich & McKee

(57) ABSTRACT

A compact induction heating system that is at least partially powered by a source of substantially clean DC current. The induction heating system includes a high frequency inverter with an input connected to a substantially clean DC current source, a first current conductive path including a first capacitor and a first switch closed to cause one half cycle of AC current to flow in the first path by discharging the first capacitor, a second current conductive path including a second capacitor and a second switch closed to cause a second half cycle of AC current to flow in the second path by discharging the second capacitor, a single load inductor in both of the paths with AC current flowing in a first direction through the inductor when the first switch is closed and in a second opposite direction through the inductor when the second switch is closed, and a gating circuit to alternately close the switches at a driven frequency to control heating by the load inductor.

17 Claims, 2 Drawing Sheets

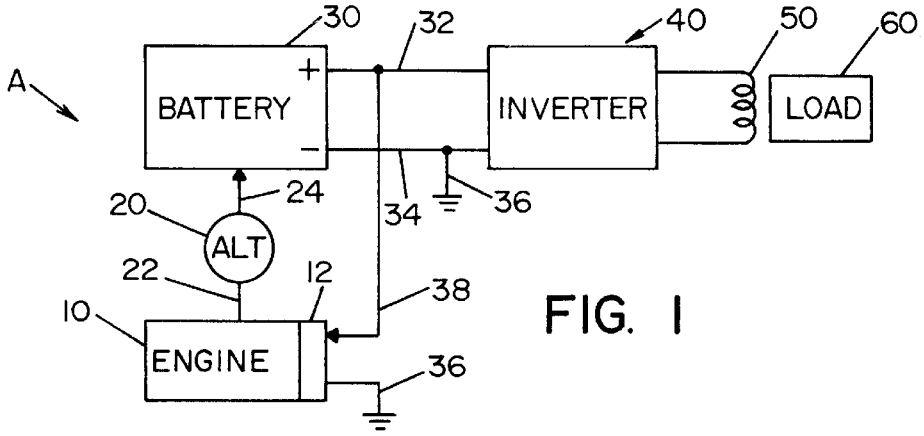
FIG. 1
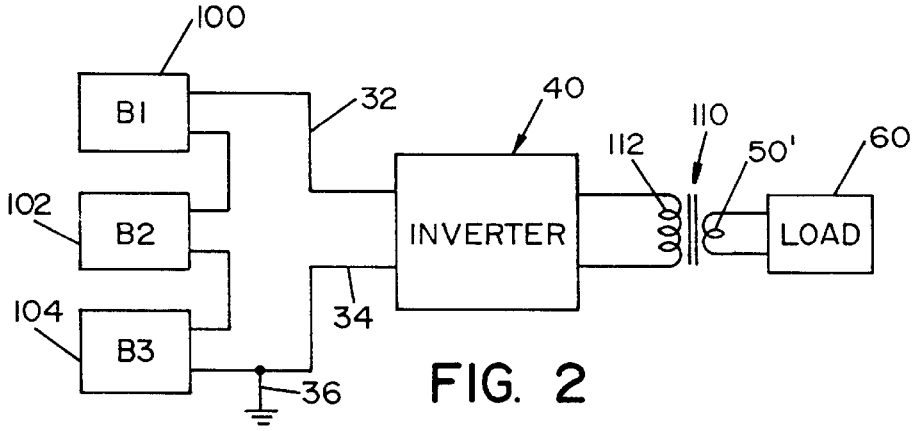
FIG. 2
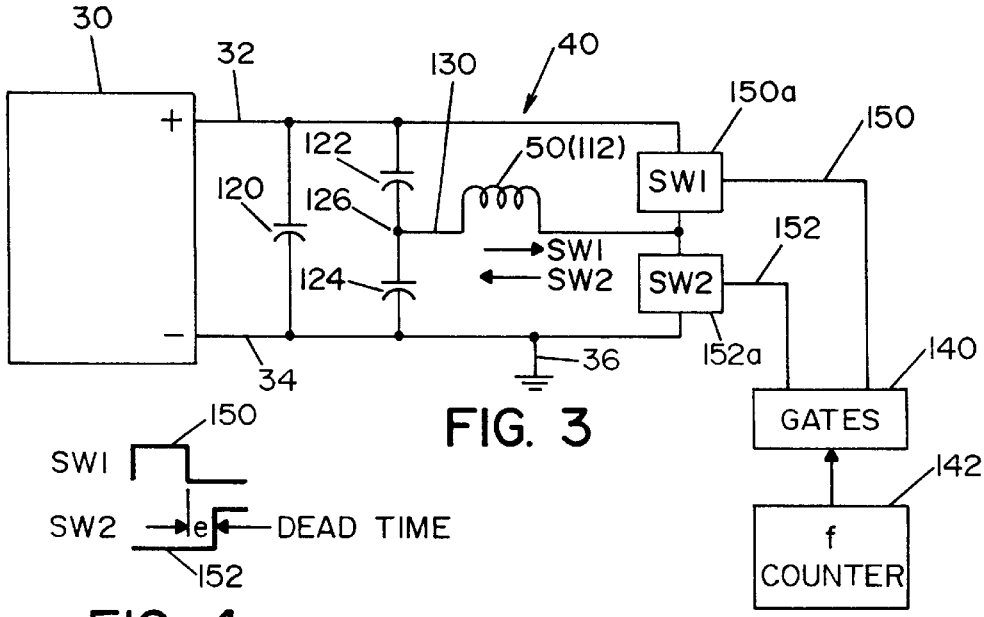
FIG. 3
FIG. 4

INDUCTION HEATING SYSTEM AND METHOD FOR INTERNAL COMBUSTION ENGINE

The present invention is a continuation-in-part of U.S. patent application Ser. No. 09/925,408 filed Aug. 10, 2001 entitled "INDUCTION HEATING SYSTEM," which is incorporated herein by reference.

The present invention relates to the art of induction heating and more particularly to a unique compact induction heating system that is at least partially powered by a DC power source.

INCORPORATION BY REFERENCE

U.S. Pat. No. 6,237,576 is incorporated herein by reference to illustrate a fuel evaporation delivery system that can be used with the present invention.

BACKGROUND OF THE INVENTION

Induction heating involves the use of an induction heating coil that is driven by alternating currents to induce voltage and thus current flow in a work piece encircled by or associated with the induction heating coil. Such technology has distinct advantages over convection heating, radiant heating, and conduction heating in that it does not require physical contact with the heated work piece or circulating gasses to convey combustion type heat energy to the work piece. Consequently, induction heating is clean, highly efficient, and usable in diverse environments. However, induction heating by work piece associated conductors normally involves power supplies connected to an AC line current. Such heating power supplies are constrained by the frequency of the incoming line. In some instances, the line voltage is three phase, which is rectified to produce a DC link and then converted to alternating current by use of an inverter.

Such DC link driven power supplies have two distinct disadvantages. They are relatively large and involve a heavy core that constitutes a major component of the input rectifier. Consequently, such power supplies cannot be fit into a small compartment, such as the area under the hood of a motor vehicle. Further, a heating system to be used in association with an internal combustion engine cannot involve induction heating, since there is no source of alternating current to drive the power supply for the induction heating coil.

SUMMARY OF THE INVENTION

The present invention overcomes the disadvantages associated with existing induction heating systems, wherein the system can be made quite compact so that it is capable of being located in a small compartment and/or which can be at least partially powered by a DC power source. The invention will be described with particular reference to an induction heating system that is located in a small compartment such as, but not limited to, the under hood of a motor vehicle or the cowling of other internal combustion engines. However, as can be appreciated, the invention has broader applications and can be used to heat any number of different substances or objects by being at least partially powered by a DC power source. Such applications include, but are not limited to, fluid heating (liquid water, ice, oil, fuel, lubricants, adhesives, cleaning fluids, various gasses or vapors, various other chemical compounds, etc.), soldering/brazing, shrink fitting, bonding/curing, air-guns, metal preheating, welding/cutting, replacing the uses of various torch applications, etc.

In one aspect of the present invention, there is provided a compact inverter having an at least partially clean DC input and components which fit into a relatively small housing with a volume of less than about 100 cubic inches. By developing a special induction heating system for use in a confined space, the advantages of induction heating can be employed for various heating functions (e.g., the confined space of an engine compartment, portable tools that involve heating, fuel cells, etc.). Consequently, the required heating operations in such a confined space can enjoy the advantages of induction heating with its efficiency, environmental friendly nature, and ease of control. In one embodiment, the DC input of the compact inverter is substantially a clean DC input. As defined herein, a clean DC input is a DC input that has not substantially been rectified thus having a minimal ripple factor that will adversely effect the operation of the high frequency inverter. Such clean DC inputs include, but are not limited to, batteries, fuel cells, solar power cells, etc. In one non-limiting example, a clean DC input is available in an implement or vehicle driven by an internal combustion engine, wherein the DC current is generated by an alternator and stored in a battery for use in the emission system of the internal combustion engine.

In accordance another and/or alternative aspect of the present invention, there is provided a compact induction heating system which utilizes a substantially clean source of DC current of less than about 100 volts. The system comprises an inverter such as, but not limited to, a high frequency inverter with an input connected to the DC source. A pair of AC tuning capacitors are connected in series across the clean DC source. Typically, the AC tuning capacitors are the same; however, the AC capacitors can be different. Each capacitor is initially charged to a portion of the input DC voltage. Typically, each capacitor is initially charged to half of the input DC voltage; however, each capacitor can be charged to different portions of the input DC voltage. The load inductor is connected at one end to the center junction of the two AC capacitors. A pair of solid state switches (e.g., IGBT transistors) are connected in series across the DC source and in parallel with the two series AC capacitors. The other end of the inductor is connected to the junction of the two switches. The switches are opened and closed (e.g., gated on and off) alternately at a frequency determined by the application (e.g., typically between about 5 kHz and about 30 kHz, but generally with a range capability of about 1 kHz to about 200 kHz; however, other ranges can be used.). The frequency of the gates can be equal to or different from the natural resonant frequency of the load. The power or the amount of heat generated can be varied by slightly adjusting the gating frequency above or below the natural resonant frequency of the load. When the first switch closes, the voltage stored in the first AC capacitor is discharged through the inductor, producing one half of the AC sinusoidal current, and back to the opposite polarity of the DC source. At the same time, the first capacitor is then charged to substantially the full potential of the DC source. The switch is then opened (turned off), and after a sufficient amount of dead time has elapsed (which dead time can be zero), the second switch is turned on. When the second switch is closed, the second AC capacitor discharges through the inductor, producing the other half of the AC sinusoidal current, and is then charged to substantially the full potential of the DC source, but in the opposite polarity of the other capacitor. This process is repeated as long as the gate signals are present. The subsequent cycles after the first cycle differ in the fact that the AC tuning capacitors are now charged to substantially the full potential of the DC input. The process is halted when the gating signals are removed or disabled. The AC current generated by the capacitor-transistor switching system (inverter) is passed though the inductor. This current induces a voltage within the part/work piece to be heated (via magnetic flux). The induced voltage develops a current within the part which meets resistance to the material which comprises the part. This resistance to current flow generates heat in the form of $I^2R$ losses, where (I) is the induced current and (R) is the resistance of the part. The heat developed in the part can be measured in watts (W). $W=I^2R$. In one embodiment of the invention, the load inductor is typically the actual induction heating coil whereby the natural frequency of the two current paths is equal to the driven frequency of the switching circuit. In another and/or alternative embodiment of the invention, the single inductor is the primary of an output transformer so that the heat controlling driven frequency can be delivered to inductors that are smaller or larger than the nominal inductor. In still another and/or alternative embodiment, the compact induction heating system is used on an internal combustion engine driven implement having an engine driven alternator to generate DC current for storage in a battery used as a source of a substantially clean DC current of less than about 50 volts for vaporization and/or ignition of fuel in the engine. In one aspect of this embodiment, the DC current source is the alternator of the engine when the engine is driven and the battery of the engine when the internal combustion engine is not operating.

In accordance with still another and/or alternative aspect of the present invention, the clean DC voltage is generally up to about 50 volts DC, typically up to 24 volts DC, more typically greater than about 6 volts DC, even more typically about 12 to 24 volts DC, and still even more typically about 12 to about 20 volts DC In one embodiment of the invention, the power supply has a lower input limit of 6 volts DC In another and/or alterative embodiment of the invention, the inductor of the inverter is an induction heating coil. In still another and/or alterative embodiment of the invention, the inductor is a primary winding of an output transformer having a secondary winding forming the induction heating coil. In yet another and/or alterative embodiment of the invention, the frequency of the heating system can be as low as about 1 kHz, and is typically in the range of about 10–20 kHz to drastically reduce this size of those components constituting the inverter. By using high frequency control of the gating circuit, the housing for the inverter can be reduced to substantially less than about 100 cubic inches. This compact size allows the invertor to be used in a variety of small and/or compact spaces. In one aspect of this embodiment, the invertor is sized so as to easily fit under the hood of a motor vehicle or the cowling of an internal combustion driven implement. One of the advantages of an induction heating system of the type to which the present invention is directed is the ability to operate at a high frequency to produce a relatively low reference depth of heating by the output induction heating coil for efficient heating of related constituents within a very confined compartment.

In accordance with yet another and/or alternative aspect of the present invention, the gating circuit includes a two state counter with an adjustable oscillator to adjust the driven frequency to at least partially tune the actual output heating of the system. In this gating circuit, there are alternate gating pulses with an adjustable dead band between the pulses to operate the first and second switches.

In accordance with still yet another and/or alternative aspect of the present invention, there is a dead time between the pulses to allow the natural frequency of the two combined conductive paths to prepare for reversing of the switches.

The primary object of the present invention is the provision of a compact induction heating system that can be mounted in a confined area for diverse operations of induction heating in such confined areas.

Yet another and/or alternative object of the present invention is the provision of a compact induction heating system which is operated at a high frequency so that it can be mounted in a relatively small housing, such as a housing having a volume of less than about 100 cubic inches.

Still another and/or alternative object of the present invention is the provision of a compact induction heating system which utilizes a unique high frequency operated inverter for converting substantially clean DC current to high frequency heating current.

These and other objects and advantages will become apparent from the following description of the present invention utilizing the accompanying drawings.

BRIEF DESCRIPTION OF THE DRAWINGS

Reference may now be made to the drawings, which illustrate various embodiments that the invention may take in physical form and in certain parts and arrangements of parts wherein:

FIG. 1 is a schematic block diagram of the preferred embodiment of the present invention;

FIG. 2 is a schematic block diagram of an embodiment of the invention utilizing the plurality of input batteries in series and an output transformer for the induction coil;

FIG. 3 is a combined wiring diagram and block diagram illustrating in more detail the inverter of the preferred embodiment of the present invention;

FIG. 4 is a gating diagram showing gate pulses for use in the embodiment of the invention shown in FIGS. 3 and 5;

PREFERRED EMBODIMENT OF THE INVENTION

Figure 5:
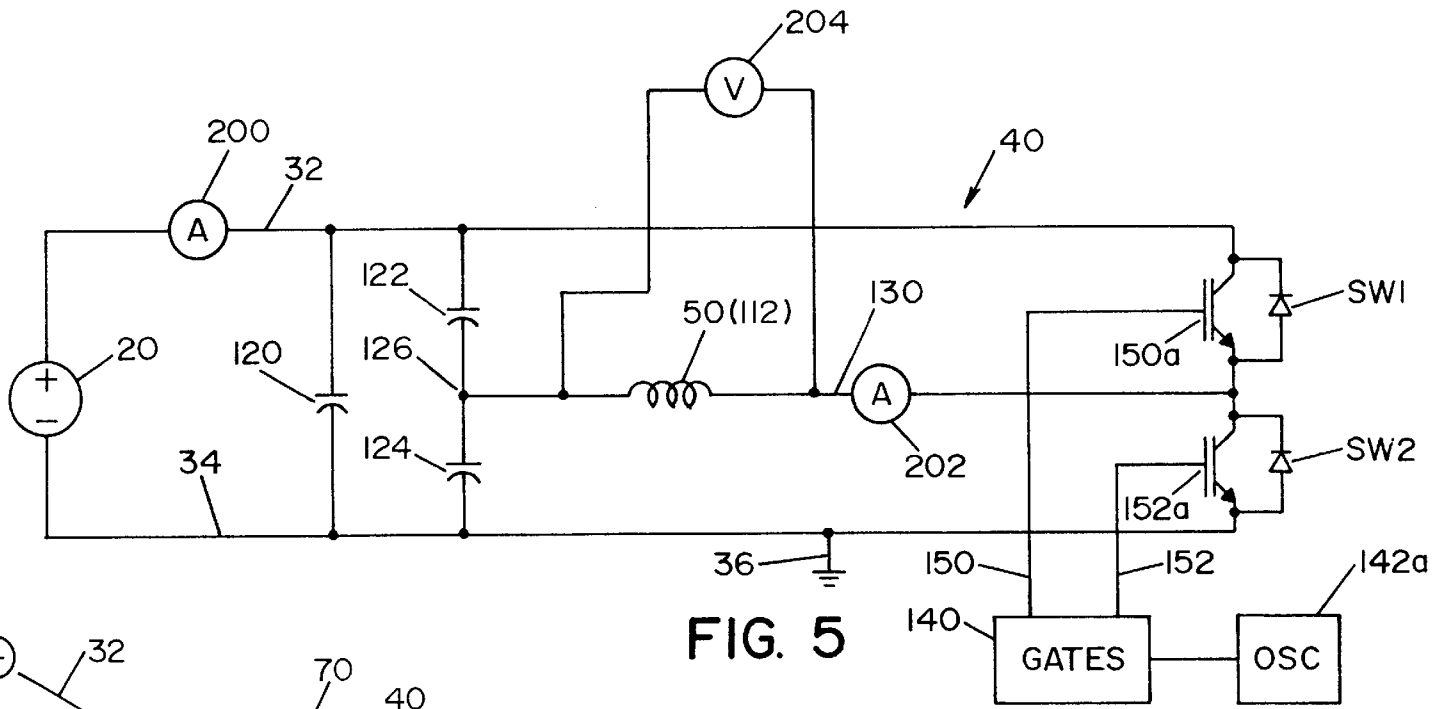
FIG. 5 is a line diagram of the preferred embodiment of the present invention as will be implemented in the practice; and, FIG. 6 is a pictorial view of the small housing used for the high frequency compact inverter contemplated by the present invention.

Referring now to the drawings wherein the showings are for the purpose of illustrating preferred embodiments of the present invention and not for the purpose of limiting the same, FIG. 1 shows an induction heating system as constructed in accordance with the present invention, and used with an internal combustion engine 10 having a standard condition system 12 whereby alternator 20 is driven by shafts 22 during operation of engine 10. In practice, the output voltage in line 24 is 12 volts DC for storing electrical energy in battery 30 to produce a clean DC current between leads 32, 34. In accordance with standard practice, the negative lead 34 is grounded at terminal 36. By this architecture, the ignition system is powered by a clean DC current directed to ignition system 12 by lead 38 connected to positive lead 32. A novel high frequency inverter 40, the details of which will be explained later, produces a high frequency current to an induction heating coil 50 for inducing a voltage in work piece 60 located in or adjacent to the coil 50. System A does not require an input rectifier and coverts the clean DC current to a driven frequency in a range of about 10–20 kHz. In this matter, the inverter utilizes small electrical components and is sized to be contained within housing 70 illustrated in FIG. 6. Housing 70 has a height a, width b, and length c to define the volume which is less than about 100 cubic inches. In practice, dimension a and dimension b are both about 3 inches. Dimension c is about 6 inches. This produces a volume of less than 60 cubic inches. Housing 70 has flanges 72, 74 with mounting holes 76 to mount the housing in restricted areas, such as the side support structure under the hood of a motor vehicle. In this manner, the induction heating coil is available for performing diverse heating functions under the hood of a vehicle utilizing an internal combustion engine without the size restraints associated with previous induction heating systems.

An alternative preferred embodiment is illustrated in FIG. 2, wherein the clean DC current in lines 32, 34 is provided by one or more storage batteries. As illustrated in FIG. 2, three batteries 100, 102 and 104 are connected in series and are used to supply the clean DC current to the inverter. Consequently, the voltage across leads 32, 34 is three times the voltage of each a storage battery. In practice, the batteries are 12 volts to develop 36 volts across leads 32, 34. Of course, the batteries could be grouped in different numbers or could be connected in parallel to generate the same amount or another amount of voltage across leads 32, 34. When connected in parallel, a voltage across leads 32, 34 is the voltage of each battery, but the energy available for the heating operation is multiplied. In all instances, the voltage is typically less than about 50 volts DC, and more typically up to about 24 volts DC In practice, the voltage is at least about 6 volts DC, and typically about 12 to 24 volts DC In FIG. 1, induction heating coil 50 heats work piece 60 directly. In FIG. 2, the output of the inverter is transformer 110 with primary winding 112. The secondary winding 50' inductively heats load 60. As can be appreciated, the load configuration in FIG. 1 can be used in FIG. 2. Furthermore, it can be appreciated that the load configuration in FIG. 2 can be used in FIG. 1.

In the embodiment illustrated in FIG. 2, the use of the transformer allows the use of inductors that are smaller and larger than the inductor used in the embodiment illustrated in FIG. 1. The use of different sized inductors may be necessary to accommodate various sizes of parts to be heated.

Figure 6:
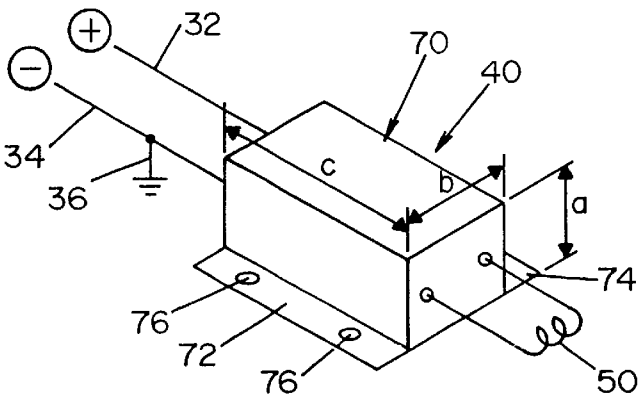

Referring now to FIG. 3, a half bridge inverter network is illustrated with a center tap capacitor branch. The half bridge inverter 40 includes an input filter capacitor 120 with series mounted capacitors 122, 124 defining center tap 126. A common branch 130 is composed of the induction heating coil 50 (112). A pair of solid state switches 150*a* and 152*a* (e.g., IGBT transistors) are also connected in series across the clean DC source 30, and in parallel with the two series AC capacitors 122 and 124. The other end of the inductor is connected to the center junction of the two switches 150*a* and 152*a*. The switches 150*a* and 152*a* are opened and closed (gated on and off) alternately at a frequency determined by the application (typically between about 10 kHz and about 20 kHz, but with a range capability of about 1 kHz to about 200 kHz). The frequency of the gates is equal to the natural resonant frequency of the induction heating coil 50 (112). The power of the amount of heat generated can be varied by slightly adjusting the gating frequency above or below the natural resonant frequency of the induction heating coil 50 (112). When the first switch 150*a* closes, the voltage stored in the first AC capacitor 124 is discharged through inductor 50 (112), producing one half of the AC sinusoidal current, and back to the opposite polarity of the clean DC source 30. At the same time, the first capacitor 124 is then charged to the full potential of the clean DC source 30. The switch 150*a* is then opened (turned off), and after a sufficient amount of dead time has elapsed, the second switch 152*a* is turned on. When the second switch 152*a* is closed, the second AC capacitor 122 then discharges through the inductor 50 (112), producing the other half of the AC sinusoidal current, and is then charged to the full potential of the clean DC source 30, but in the opposite polarity of the other capacitor 122. This process is then repeated as long as the gate signals are present. The subsequent cycles after the first cycle differ in the fact that the AC tuning capacitors are now charged to the full potential of the clean DC input. Gating circuit 140 causes alternate gating pulses in gate lines 150, 152. The frequency of these alternations of gating pulses is controlled by the oscillator driving two state counter 142. The counter produces pulses in opposite directions and is a circuit like a flip-flop or other similar circuit to produce pulses 150, 152 as shown in FIG. 4. These pulses are separated by a distance or time (e) defining a dead time between gating pulses to allow the high frequency components of inverter 40 to transition into a condition awaiting reversal of current flow in branch 130. Since the frequency from gating circuit 140 is normally between about 10 and about 20 kHz, the components of inverter 40 are quite small and can be mounted into housing 70 as shown in FIG. 6.

In one overview, the system comprises a high frequency inverter with an input connected to the clean DC source. A pair of identical AC tuning capacitors are connected in series across the clean DC source. Each capacitor is initially charged to one half the input DC voltage. The load inductor is connected at one end to the center junction of the two AC capacitors. A pair of solid state switches (e.g., IGBT transistors) are also connected in series across the clean DC source and in parallel with the two series AC capacitors. The other end of the inductor is connected to the center junction of the two switches. The switches are opened and closed (gated on and off) alternately at a frequency determined by the application (typically between about 10 kHz and about 20 kHz, but with a range capability of about 1 kHz to about 200 kHz). The frequency of the gates is typically equal to the natural resonant frequency of the load. The power of the amount of heat generated can be varied by slightly adjusting the gating frequency above or below the natural resonant frequency of the load. When the first switch closes, the voltage stored in the first AC capacitor is discharged through the inductor, producing one half of the AC sinusoidal current, and back to the opposite polarity of the clean DC source. At the same time, the first capacitor is then charged to the full potential of the clean DC source. The switch is then opened (turned off), and after a sufficient amount of dead time has elapsed, the second switch is turned on. When the second switch is closed, the second AC capacitor then discharges through the inductor, producing the other half of the AC sinusoidal current, and is then charged to the full potential of the clean DC source, but in the opposite polarity of the other capacitor. This process is then repeated as long as the gate signals are present. The subsequent cycles after the first cycle differ in the fact that the AC tuning capacitors are now charged to the full potential of the clean DC input. The process is halted when the gating signals are removed or disabled. The AC current generated by the capacitor-transistor switching system (inverter) is passed though the inductor. This current induces a voltage within the part/work piece to be heated (via magnetic flux). The induced voltage develops a current within the part which meets resistance to the material which comprises the part. This resistance to current flow generates heat form of $I^2R$ losses, where (I) is the induced current and (R) is the resistance of the part. The heat developed in the part can be measured in watts (W). $W=I^2R$.

A more detailed layout of inverter 40 is illustrated in FIG. 5 where alternator 20 powers the inverter during operation of internal combustion engine 10. Switches SW1, SW2 are IGBT switches having gating terminals 150*a*, 152*a* controlled by pulses 150, 152, as shown in FIG. 4. The IGBT switches can be changed to other types of switches such as, but not limited to, Mosfet switches for higher frequencies. The frequency of oscillator 142*a* is adjusted to control the heating at induction heating coil 50 (112). One half cycle of AC current flows in a first conductive path when switch SW1 is closed and switch SW2 is opened. The opposite one half cycle of AC current flows in the second path when the switches are reversed. Common branch 130 is a part of both conductive paths. Current in lead 32 is read by DC amp meter 200 and is compared with the current in branch 130 measured by AC amp meter 202. The voltage across load coil 50 is measured by volt meter 204 to determine the relationship between the reversed current flow in branch 130. Meters 200–204 shown in FIG. 5 are for the purposes of monitoring the operation of inverter 40 prior to packaging the inverter in housing 70 shown in FIG. 6. The components illustrated in FIG. 5, in practice, are as follows:

| | |
|---|---|
| Capacitor 120 | 100 $\mu$F |
| Capacitor 122 | 7.5 $\mu$F |
| Capacitor 124 | 7.5 $\mu$F |
| Coil 50 | 108 $\mu$H |

The readings of the meters shown in FIG. 5 are as follows:

| | |
|---|---|
| Meter 200 | 10–34 amperes DC |
| Meter 202 | 33–102 amperes AC |
| Meter 204 | 17–60 volts AC |

In one specific embodiment of the present invention, a small power supply operated by a 12 volt DC input current using a gating card is used. The small induction heating unit is mounted under the hood of an internal combustion driven vehicle or other type of engine compartment. The inverter is an IGBT based solid state induction heating power supply capable of operating at a relatively low DC bus voltage in the neighborhood of about 12–42 volts DC The switches are No. SK 260MB10 by Semikron rated at about 180 amperes and about 100 volts. The switches can be Mosfets. The power supply's main design feature is that it can obtain the necessary power from a standard engine alternator. The induction heating source does not require an AC voltage as required by standard induction heating installations. Any "clean" DC supply will work to power the inverter. In practice, the supply is an alternator or battery. It could also be operated by a solar cell or a fuel cell. From the DC source, the power supply will convert the DC voltage to a single phase high frequency DC voltage at approximately 20 kHz. The power supply is not necessarily limited to a specific frequency. A general range of about 1 kHz to about 200 kHz can be used. When making this frequency adjustment, component changes may be made to adjust the operating frequency of the power supply. The power supply is capable of delivering power up to about 1500 watts on a 42 volt DC input voltage. The amount of power can be increased or decreased based upon the amount of input voltage or the frequency of the power supply. Typically, the frequency is fixed, but the operating frequency may be adjusted above or below the resonant frequency of the load to reduce the amount of output power. The size of the unit is quite compact and can be air cooled, not requiring any fan; however, a fan, cooling fluid and/or the like can be used. The amount of heat is varied by the frequency of the gating pulses. Of course, heating can be varied by duty cycle operation of induction heating system A.

In summary of another embodiment of the present invention, the induction heater is a transistorized or Mosfet solid-state induction heating power source capable of operating on a relatively low DC bus voltage (e.g., 6–50 volts). One of the power supply's principle design features is that it is operable from a common DC power source (e.g. vehicle battery, aircraft battery, marine battery, train battery, fuel cell, solar cell, welding generator, other chemical batteries, etc.). As a result, the induction heating power source does not require an AC input voltage as do most induction heaters. From the DC power source, the power supply will convert the DC voltage to a single-phase high frequency AC voltage at about 10–30 kHz, but can be in a range of about 1–200 kHz. The unique features of the induction heater are:

a. The ability to operate off of any substantially clean DC power source.

b. The compact design of the induction heater (typically less than about 100 cubic inches).

c. A simplified cooling design. Typically the induction heater can be air cooled; however, cooling fans and/or water can be used.

d. An integral temperature control module that controls the amount of heat into the work piece by varying the operating frequency, and/or turning the heat on and off.

The present invention has been described for use in the engine compartment of an internal combustion engine. In such an application, the induction heating system can be used to preheat fuel for the combustion engine. Such an application of the induction heating system is disclosed in U.S. Pat. No. 6,237,576, which is incorporated herein by reference. As can be appreciated, the induction heating system could also or alternatively be used to heat fuel in the fuel lines and/or engine of the combustion engine. As can be appreciated, the use of the induction heating system in an internal combustion engine of a vehicle can also be used for boats, trains, airplanes, etc. As can further be appreciated, the induction heating system is not limited for used with combustion engines, and can be used for a wide variety of other applications that involve the use of heat such as, but not limited to, fluid heating (liquid water, ice, oil, fuel, lubricants, adhesives, cleaning fluids, various gasses or vapors, various other chemical compounds, etc.), soldering/brazing, shrink fitting, bonding/curing, air-guns, metal preheating, welding/cutting, replacing the uses of various torch applications, etc.

The present invention has been described with reference to a number of different embodiments. It is to be understood that the invention is not limited to the exact details of construction, operation, exact materials or embodiments shown and described, as obvious modifications and equivalents will be apparent to one skilled in the art. It is believed that many modifications and alterations to the embodiments disclosed will readily suggest themselves to those skilled in the art upon reading and understanding the detailed description of the invention. It is intended to include all such modifications and alterations insofar as they come within the scope of the present invention.

I claim:

1. An induction heating system that is at least partially powered by a source of substantially clean DC current, said system comprising a high frequency inverter with an input connected to said substantially clean DC current source, a first current conductive path including a first capacitor and a first switch closed to cause one half cycle of AC current to flow in said first path by discharging said first capacitor, a second current conductive path including a second capacitor and a second switch closed to cause a second half cycle of AC current to flow in said second path by discharging said second capacitor, a single load inductor in both of said paths with AC current flowing in a first direction through said inductor when said first switch is closed and in a second opposite direction through said inductor when said second switch is closed and a gating circuit to alternately close said switches at a driven frequency between 10 KHz and 20 KHz to control heating by said load inductor, each of said paths having a given natural frequency, and said driven frequency being adjustable to a value about the natural frequency of said load, said high frequency inverter being contained in a housing having a volume of less than about 100 cubic inches, and an air cooling system, said air cooling system being a natural air cooling system that is absent the use of cooling fans.

2. The induction heating system as defined in claim 1, wherein said substantially clean DC current source is less than about 100 volts.

3. The induction heating system as defined in claim 2, wherein said substantially clean DC current source is less than about 50 volts.

4. The induction heating system as defined in claim 3, wherein said substantially clean DC current source is less than about 24 volts.

5. The induction heating system as defined in claim 1, wherein said high frequency inverter is substantially fully powered by said substantially clean DC current source.

6. The induction heating system as defined in claim 1, wherein said substantially clean DC current source is a storage battery used in association with an internal combustion engine.

7. The induction heating system as defined in claim 1, wherein said load inductor heats fluid.

8. The induction heating system as defined in claim 1, wherein said driven frequency is adjustable between a value less than said natural frequency of said load.

9. The induction heating system as defined in claim 1, wherein said driven frequency is adjustable between a value greater than said natural frequency of said load.

10. The induction heating system as defined in claim 1, wherein said inductor is an induction heating coil.

11. The induction heating system as defined in claim 1, wherein said inductor is a primary winding of an output transformer having a secondary winding in the form of an induction heating coil.

12. The induction heating system as defined in claim 1, including an adjustable counter to adjust said driven frequency to control the heat output of said system.

13. The induction heating system as defined in claim 1, wherein said gating circuit includes a circuit which creates alternate gate pulses for said first and second switches with a dead time between said gate pulses.

14. An induction heating system for heating a fluid that is powered by a source of substantially clean DC current, said system comprising a high frequency inverter with an input connected to said substantially clean DC current source that is less than about 50 volts, a first current conductive path including a first capacitor and a first switch closed to cause one half cycle of AC current to flow in said first path by discharging said first capacitor, a second current conductive path including a second capacitor and a second switch closed to cause a second half cycle of AC current to flow in said second path by discharging said second capacitor, a single load inductor in both of said paths with AC current flowing in a first direction through said inductor when said first switch is closed and in a second opposite direction through said inductor when said second switch is closed and a gating circuit to alternately close said switches at a driven frequency between 10 KHz and 20 KHz to control heating by said load inductor, each of said paths having a given natural frequency, said driven frequency being adjustable to a value about the natural frequency of said load, said high frequency inverter being contained in a housing having a volume of less than about 100 cubic inches, an air cooling system, said air cooling system being a natural air cooling system that is absent the use of cooling fans, said inductor including an induction heating coil.

15. The induction heating system as defined in claim 14, including an adjustable counter to adjust said driven frequency to control the heat output of said system.

16. The induction heating system as defined in claim 14, wherein said gating circuit includes a circuit which creates alternate gate pulses for said first and second switches with a dead time between said gate pulses.

17. The method of heating a fluid by an induction heating system that is at least partially powered by a source of substantially clean DC current comprising:

a. providing a substantially clean DC current source that is less than about 100 volts;

b. providing a high frequency inverter with an input to receive said substantially clean DC current source, said inverter including a first current conductive path having a first capacitor and a first switch closed to cause one half cycle of AC current to flow in said first path by discharging said first capacitor, a second current conductive path having a second capacitor and a second switch closed to cause a second half cycle of AC current to flow in said second path by discharging said second capacitor, and a gating circuit to alternately close said switches at a driven frequency of less than about 200 kHz;

c. providing a single load inductor in both of said paths with AC current flowing in a first direction through said inductor when said first switch is closed and in a second opposite direction through said inductor when said second switch is closed, said inductor including an induction heating coil, said gating circuit controlling heating by said load inductor, said inductor including an induction heating coil, each of said paths having a given natural frequency, said driven frequency being adjustable to a value about the natural frequency of said load inductor, said high frequency inverter being contained in a housing having a volume of less than about 100 cubic inches, an air cooling system, said air cooling system being a natural air cooling system that is absent the use of cooling fans; and d. connecting said substantially clean DC current source to said high frequency inverter to cause said induction heating coil to heat said fluid.

* * * * *